US005711554A

United States Patent [19]

Brown et al.

[11] Patent Number: 5,711,554

[45] Date of Patent: Jan. 27, 1998

[54] ENCLOSURE SAFETY LATCH

[75] Inventors: David C. Brown, Chicago; Michael C. Thuma, Des Plaines; Craig S. Scherer, Wilmette, all of Ill.

[73] Assignee: BRK Brands, Inc., Aurora, Ill.

[21] Appl. No.: 651,832

[22] Filed: May 21, 1996

[51] Int. Cl.[6] ..... E05C 19/06

[52] U.S. Cl. ..... 292/19; 292/17; 292/87

[58] Field of Search ..... 292/19, 17, 37, 292/38, 83, 85, 87, DIG. 16, DIG. 19, DIG. 38

[56] References Cited

U.S. PATENT DOCUMENTS

| | | | |
|---|---|---|---|
| 444,019 | 1/1891 | Richards | 292/17 |
| 504,142 | 8/1893 | Wilburn | 292/17 |
| 1,002,013 | 8/1911 | Urban . | |
| 1,147,530 | 7/1915 | Mentz . | |
| 1,670,908 | 5/1928 | Smith . | |
| 1,719,343 | 1/1929 | Strayer . | |
| 1,773,751 | 8/1930 | Reidhaar . | |
| 1,891,065 | 12/1932 | Sitton . | |
| 2,003,856 | 6/1935 | Gimbel . | |
| 2,199,369 | 4/1940 | Bernstein . | |
| 2,374,426 | 4/1945 | Diederich . | |
| 2,393,647 | 1/1946 | Marple . | |
| 2,524,940 | 10/1950 | Surridge . | |
| 2,608,711 | 9/1952 | Moore . | |
| 2,685,473 | 8/1954 | Adell . | |
| 2,797,655 | 7/1957 | Morehouse . | |
| 2,879,123 | 3/1959 | Newcomer, Jr. et al. . | |
| 2,904,986 | 9/1959 | Anderson . | |
| 2,918,318 | 12/1959 | Sacharski . | |
| 2,924,476 | 2/1960 | Deane . | |
| 2,975,491 | 3/1961 | Paul et al. . | |
| 3,059,952 | 10/1962 | Wittman et al. . | |
| 3,061,346 | 10/1962 | Jorgensen | 291/DIG. 38 X |
| 3,069,217 | 12/1962 | Kors . | |
| 3,144,268 | 8/1964 | Rowe . | |
| 3,161,923 | 12/1964 | Crain . | |
| 3,308,126 | 3/1967 | Schuette . | |
| 3,317,231 | 5/1967 | Lindquist et al. . | |
| 3,397,001 | 8/1968 | Friedman . | |
| 3,463,530 | 8/1969 | Modes . | |
| 3,591,219 | 7/1971 | Graziosa . | |
| 3,621,684 | 11/1971 | Horvay et al. . | |
| 3,791,683 | 2/1974 | Bright . | |
| 3,797,871 | 3/1974 | Morishita . | |
| 3,801,143 | 4/1974 | Gutner . | |
| 3,831,987 | 8/1974 | Misenheimer, III . | |
| 3,836,187 | 9/1974 | Buetner . | |
| 3,918,752 | 11/1975 | Leone et al. . | |
| 3,936,083 | 2/1976 | Bright . | |
| 3,938,837 | 2/1976 | Bright . | |
| 4,132,440 | 1/1979 | Johnson . | |
| 4,159,838 | 7/1979 | Wilzig et al. . | |

(List continued on next page.)

FOREIGN PATENT DOCUMENTS

| | | |
|---|---|---|
| 2367176 | 10/1977 | France . |
| 26 55 031 | 12/1976 | Germany . |

*Primary Examiner*—Rodney M. Lindsey

*Attorney, Agent, or Firm*—Dressler, Rockey, Milnamow & Katz, Ltd.

[57] ABSTRACT

A safety latch for latching a door of an enclosure to the enclosure includes a receiving member mounted to the enclosure and a latching member engageable with the receiving member, adapted to be mounted to the enclosure door. The receiving member includes a base portion for mounting to the enclosure and a receiving post-extending from the base portion. The receiving post has first and second diverging surfaces. The latching member has first and second generally symmetrical, opposingly oriented, spaced apart, biased latching elements. The latching elements are biased toward one another, and are configured for independent locking engagement with the receiving post when the receiving post is inserted into the latching member. Each of the latching elements includes a releasing member extending therefrom and operably connected thereto for releasing the latching member from locking engagement with the receiving post.

13 Claims, 2 Drawing Sheets

U.S. PATENT DOCUMENTS 4,198,084 4/1980 Trotta .
4,250,599 2/1981 Nagashima et al. ..... 292/17 X
4,288,119 9/1981 Geige .
4,290,633 9/1981 Sullivan .
4,330,147 5/1982 Nolen .
4,378,948 4/1983 Chrones .
4,383,707 5/1983 Nishimura .
4,416,477 11/1983 Bialobrzeski et al. .
4,469,358 9/1984 Abbott .
4,471,980 9/1984 Hickman .
4,500,120 2/1985 Ridgewell et al. ..... 292/19
4,529,235 7/1985 Florentine, Sr. .
4,575,140 3/1986 Dargis .
4,648,637 3/1987 Walter .
4,660,871 4/1987 Arakawa et al. .
4,662,664 5/1987 Wendt et al. ..... 292/19
4,712,816 12/1987 Mueller .
4,715,629 12/1987 Robinson .
4,763,607 8/1988 Tominaga .
4,772,243 9/1988 Zeiss .
4,792,165 12/1988 Nishimura .
4,812,056 3/1989 Zeike ..... 292/19 X
4,832,384 5/1989 Venable .
4,854,448 8/1989 Hair, II .
4,881,764 11/1989 Takahashi et al. ..... 292/DIG. 38 X
4,895,401 1/1990 Thornton et al. .
4,909,551 3/1990 Buchanan ..... 292/DIG. 38 X
4,991,416 2/1991 Resendez, Jr. et al. .
5,070,714 12/1991 Bedford .
5,114,194 5/1992 Toifl et al. .
5,188,403 2/1993 Anderson ..... 292/17
5,203,597 4/1993 Wheelock .
5,209,533 5/1993 Menard .
5,265,921 11/1993 Nikitas et al. .
5,387,018 2/1995 Pinkerton .
5,388,876 2/1995 Saincome .

FIG. 4
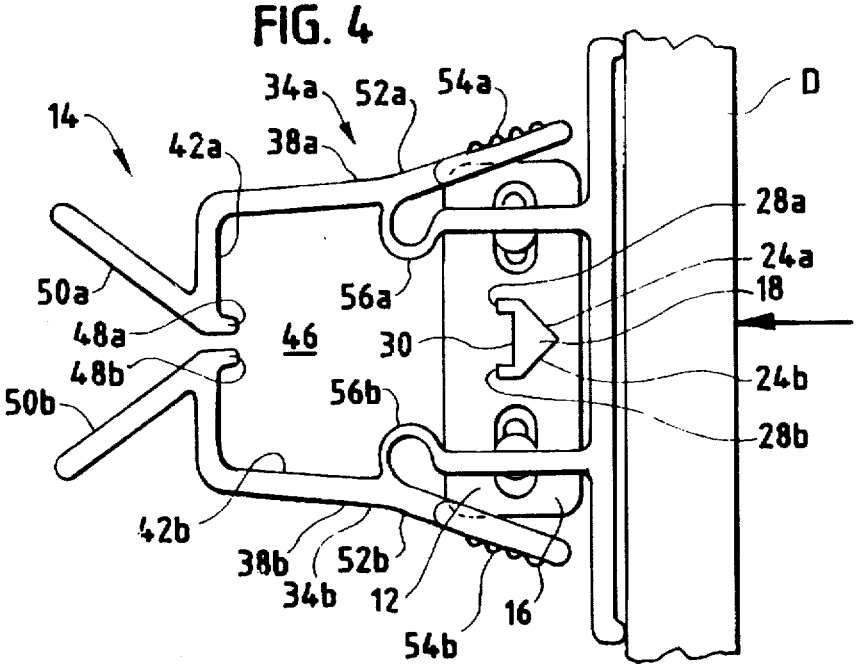
FIG. 5
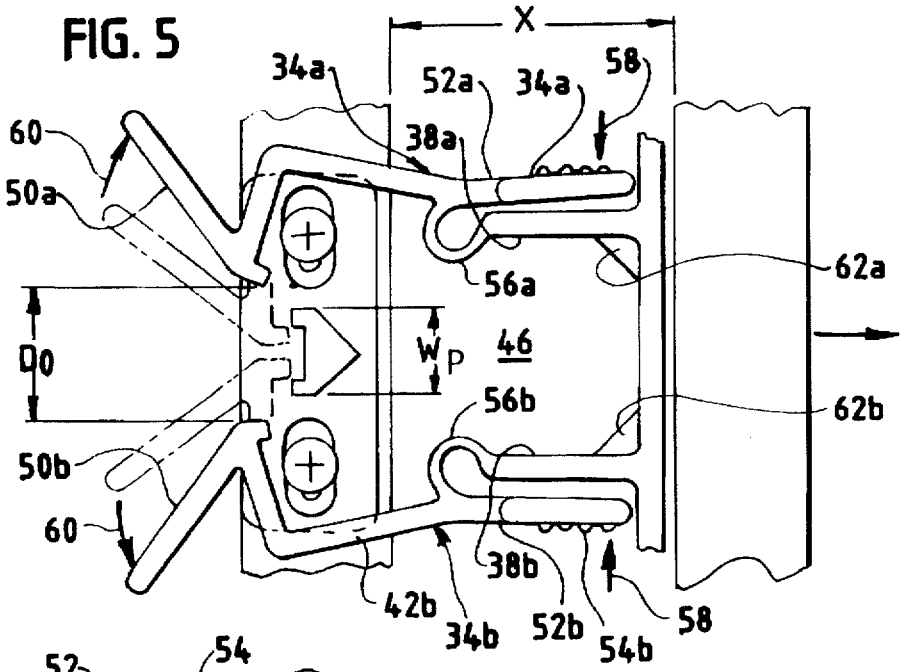
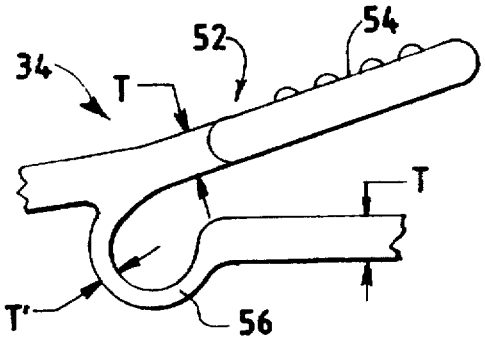
FIG. 6

ENCLOSURE SAFETY LATCH

FIELD OF THE INVENTION

This invention relates to safety latches for enclosures such as cabinets and the like. More particularly, the invention relates to biased safety latches which are mounted fully within an associated enclosure and which require more than one finger to release.

BACKGROUND OF THE INVENTION

Safety latches for enclosures and the like are well known in the art. Such latches are used, for example, to secure an enclosure, such as a kitchen drawer or cabinet which may contain household cleaners, knives and other potentially dangerous items. It will be recognized that securing enclosures containing such items is desirable when, for example there are small children in the household.

One alternative to providing latches on such enclosures is to place such items out of reach of the small children. However, this may be an inconvenience, or may be impossible in some households. As such, enclosure latches have become quite popular in homes, and may be found in many, if not most homes with small children.

One type of known enclosure latch includes a single, elongated hook-like portion which is mounted to the enclosure door, and a receiving portion which is mounted to the enclosure, for example, on an inside surface transverse to the door. In use, the door is opened sufficiently for an individual to place their finger on the hook-like portion. With finger pressure, the hook-like portion is flexed or moved away from the receiving portion sufficiently for the hook-like portion to bypass the receiving portion, and to fully open the door.

There are a number of drawbacks to such an enclosure latch. First, because the latch is readily released by the pressure of a single finger on a single member, a small child may be able to operate the latch. In addition, it may be possible to defeat such a latch by pulling on the cabinet door with sufficient force to either overcome the latch mechanism or to break the elongated member.

Another known safety latch includes a pair of independent, similarly oriented, elongated hook-like members which are separated by a wall or partition. The members are configured to engage a portion of the enclosure, such as a frame member. Each of the hook-like members must be independently flexed to release the latch mechanism and open the door. The drawback to this type of latch is that is requires a frame member or like structural member to engage, and may not be usable on a frameless type of cabinet.

In addition, latches which include a single elongated hook member or multiple, similarly oriented hook members may be defeated by leaning on a drawer as it is pulled out of the enclosure, or by pulling a cabinet door axially along its axis of rotation.

Accordingly, there continues to be a need for an enclosure or cabinet latch which may be used with most any type of enclosure, and which includes more than one, independent, opposingly oriented latching members. Preferably, such a latch requires more than one finger to manipulate, and is readily installed in the interior of the cabinet, so as to not be visible from the outside.

SUMMARY OF THE INVENTION

A safety latch for latching a door of an enclosure to the enclosure includes a receiving member mounted to the enclosure and a latching member engageable with the receiving member, adapted to be mounted to the enclosure door. The latch is configured to readily permit installation by most consumers, with a minimum of tools, in a relatively short period of time.

The receiving member includes a base portion for mounting to the enclosure surface, and a receiving post extending from the base portion. The receiving post has first and second diverging surfaces.

The latching member includes a base portion for mounting to the enclosure door. First and second generally symmetrical, spaced apart, biased latching elements, extend generally transversely from the base portion. The latching elements are biased toward one another, and are configured for independent locking engagement with the receiving post when the receiving post is inserted into the latching member.

Each of the latching elements includes a releasing member extending therefrom and operably connected thereto for releasing the latching member from locking engagement with the receiving post.

In one embodiment, each of the latching elements includes a hook-shaped portion extending toward the other of the latching elements. The hook-shaped portions define a substantially enclosed latching region. The hook-shaped portions are adapted to engage the receiving post when the post is disposed within the latching region.

The releasing members may be connected to their respective latching elements by a lever-like portion. The lever-like portion transposes the inward movement of the releasing members toward one another, to an outward movement of the latching elements away from one another, to release the latching member from the receiving post.

The latching elements may each also include an inclined guide surface extending from an end thereof. The guide surfaces diverge one from the other. The guide surfaces are adapted to engage and move along the receiving post, in a cam-like manner, when the latching member is engaged therewith, to facilitate engagement of the receiving post with the latching member and insertion of the post into the latching region.

Other features and advantages of the present invention will be apparent from the following detailed description, the accompanying drawings, and the appended claims.

BRIEF DESCRIPTION OF THE FIGURES

FIG. 4 is a side view similar to FIG. 3, illustrating the enclosure latch with the receiving post disposed within the latching region, with the enclosure door in the closed position;

FIG. 5 is a side view similar to FIG. 4, illustrating the enclosure latch manipulated to the release position with the releasing members depressed to open the latch, and showing the latched position in phantom lines, as the door is opened; and FIG. 6 is a partial side view of the releasing member.

DETAILED DESCRIPTION OF THE PREFERRED EMBODIMENTS

Figure 1:
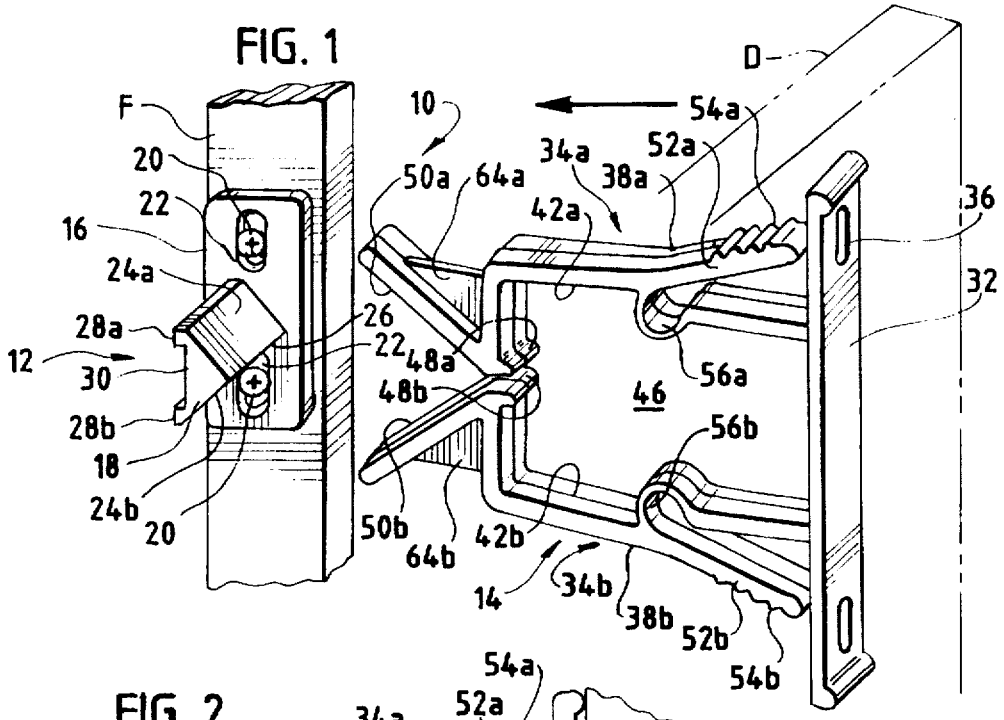
FIG. 1 is a perspective view of the enclosure latch embodying the principles of the present invention, illustrated with the receiving member mounted to a frame member of the enclosure, and the latching member being mounted to a door of the enclosure shown in phantom lines.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

With reference now to the figures, and particularly to FIG. 1, there is shown a safety enclosure latch 10 embodying the principles of the present invention. The latch 10 is intended for use with an associated enclosure, the door D of which is illustrated in phantom in FIG. 1, and in partial view in FIGS. 2–5, and a frame or jamb portion F, which is shown in partial view in FIGS. 1 and 5.

The latch 10 includes generally, a receiving member 12 and a latching member 14. The receiving member 12 is configured to be mounted to the frame or jamb portion F of the enclosure. The latching member 14 is configured to be mounted to the enclosure door D. The latch 10 is configured to readily permit installation by most consumers. Essentially, the type of hardware required for installation permits, the latch 10 to be installed with a minimum of tools, in a relatively short period of time.

The receiving portion 12 includes a base portion 16 and a receiving post 18. The base portion 16 is adapted to be directly mounted and fastened to the frame F, by fasteners, such as by the exemplary screws 20. The base portion 16 may include a pair of slotted openings 22 therein to permit adjusting the location of the receiving portion 12 relative to the frame F and the latch member 14, to assure proper operation of the latch 10.

The receiving post 18 extends generally transversely from the base portion 16. In a preferred embodiment, the post 18 includes a pair of diverging surfaces 24*a,b* which meet at one end, as illustrated at 26 and may terminate in locking projections 28*a,b* extending from the surfaces 24*a,b* at respective opposites ends thereof. The area between the projections 28*a,b* defines a locking region 30. Essentially, the post 18 can be viewed as having an "arrow-head" cross-sectional shape, as best seen in FIGS. 2–5.

The receiving member 12 is adapted to engage the latching member 14. The latching member 14 is configured to be directly mounted and fastened to the door D, by fasteners, such as screws. The latching member 14 includes a base portion 32 and first and second generally symmetrical, opposingly oriented, biased latching elements 34*a,b*. Similar to the receiving portion 12, the latching portion 14 may include slotted openings 36 in the base portion 32 to permit adjusting the location of the latching member 14 relative to the receiving portion 12 and the door D.

The latching elements 34*a,b* are spaced one from the other and extend generally transversely from the base portion 32. Each latching element 34*a,b* includes a main body portion 38*a,b* and a hook-shaped portion 42*a,b*, which extend from an end thereof distal from the base portion 32. The hook-shaped portions 42*a,b* extend toward each other. The hook-shaped portions 42*a,b* and the main body portions 38*a,b* define a substantially enclosed latching region 46. The latching elements 34*a,b* are biased toward each other to maintain the latching region 46 substantially enclosed, until it is opened by a user, or by interaction of the latching elements 34*a,b* with the receiving post 18, as the door D is closed.

Advantageously, the latching elements 34*a,b* are configured such that each functions independent of the other, and each operates regardless of whether the other is present. In addition, because of the opposing orientation of the elements 34*a,b*, at least one of the latching elements 34*a,b* will operate even if the enclosure door D is shifted.

Each of the hook shaped portions 42*a,b* includes a locking lip 48*a,b* at about an end thereof, proximal to the other of the hook-shaped portions 42*a,b*. The lips 48*a,b* are configured to coact with the locking projections 28*a,b* of the receiving post 18 when the receiving member 12 and the latching member 14 are engaged with each other. Preferably, the lips 48*a,b* extend inwardly of the latching region 46 and the post 18 locking region 30, when the latching member 14 and the receiving member 12 are engaged with each other.

The latching elements 34*a,b* each include an inclined guide surface 50*a,b* extending from their respective hook-like portions 42*a,b*. The guide surfaces 50*a,b* are oriented in a diverging manner one relative to the other. The guide surfaces 50*a,b* are configured to coact with, and move along their respective diverging surfaces 24*a,b* of the receiving post 18, in a cam-like manner, to facilitate engagement of the receiving post 18 and the latching member 14.

Each of the latching elements 34*a,b* further includes a releasing member 52*a,b* which extends from the main body portion 38*a,b*, intermediate the base portion 32 and the hook-shaped portion 42*a,b*. The releasing members 52*a,b* extend rearwardly, toward the base portion 32, and define a gripping region 54*a,b*.

The releasing members 52*a,b* are operably connected to their respective latching elements 34*a,b* by a lever-like arrangement 56*a,b*. Each lever 56*a,b* is configured such that inward pressure on the gripping regions 54*a,b*, illustrated by the arrows 58, urges the gripping regions 54*a,b* inward, which is transposed and moves the hook-shaped portions 42*a,b* outward relative to each other, as illustrated by the arrows 60. The latching member 14 is configured such that when the hook-shaped portions 42*a,b* are moved outward, they open a distance $D_o$ greater than the width $W_p$ of the receiving post 18. Thus, the latching elements 34*a,b* will pass over the post 18 to disengage the latch 10.

Each of the latching elements 34*a,b* may further include gussets, such as the base gussets 62*a,b* and the inclined surface gussets 64*a,b*. The gussets provide additional rigidity to the latching member 14, and strength to the various elements. The gussets further prevent inadvertent release of the latch 10 and preclude breaking of the members.

The use and operation of the latch 10 will now be described with reference to FIGS. 2–5, which illustrates the sequence of closing the enclosure door D and subsequent opening thereof, by release of the latch 10.

Figure 2:
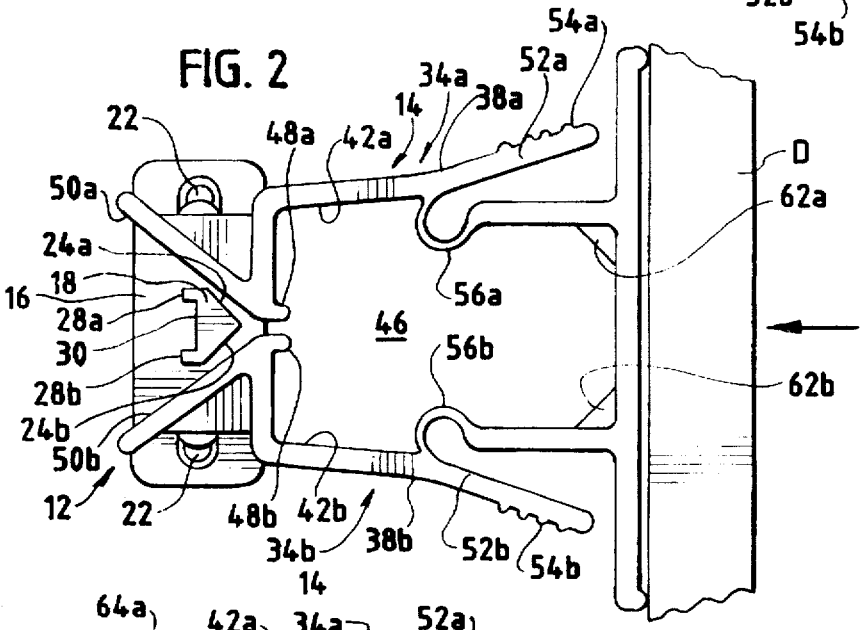
FIG. 2 is a side view of the enclosure latch of FIG. 1, as viewed from just inside of the enclosure, illustrating the latching member disengaged from, but proximal to the receiving member, as the associated door is moved to the closed position.
Figure 3:
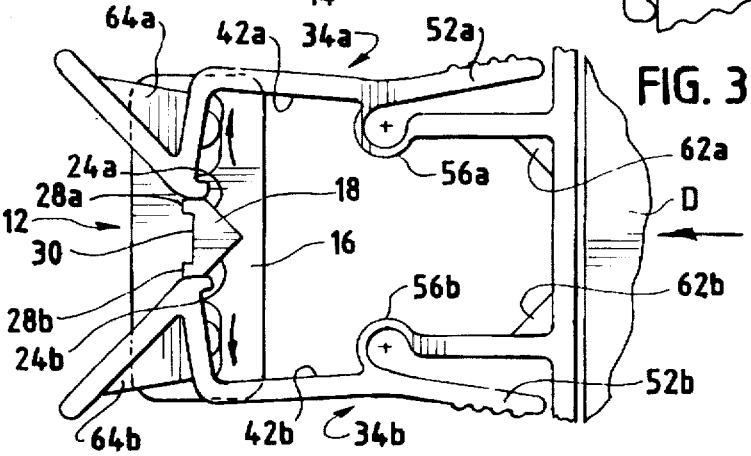
FIG. 3 is a side view similar to FIG. 2, illustrating the latching member as it is engaging the receiving member, with the biased latching elements moving along the diverging surfaces of the receiving post in a cam-like manner, as the associated door is moved further to closed position.

FIG. 2 illustrates the door D in the open position, and being moved to a closed position. The latching member 14 is not engaged with the receiving member 12. FIG. 3 illustrates the door D as it is closing, with the latching member 14 engaging the receiving post 18. The diverging surfaces 24*a,b* act as cams, and coact with the guide surfaces 50*a,b* to urge the biased latching members 34*a,b* outward, or apart, as illustrated by the arrows at 60.

As the door D is further closed, the hook-shaped portions 42*a,b* fully pass over the receiving post 18, and the receiving post 18 becomes positioned within the latching region 46. If, at this point, an attempt is made to pull the door D open without opening the latch 10, the hook-shaped portions 42*a,b* engaged the receiving post 18 which prevents the door D from opening more than the distance X, illustrated in FIG. 5.

To open the door, the latch 10 must first be released. The door D is opened a distance sufficient for a user to place his or her fingers inside the enclosure, on the latching member 14. The door D is released slightly, so that the locking projections 28*a,b* do not engage the locking lips 48*a,b*. Pressure is applied inwardly on the gripping regions 54*a,b* which is transposed to move the hook-shaped portions 42*a,b* outward. The door D can then be opened, with the latching elements 34*a,b* passing over, and not engaging the post 18.

It will be recognized by those skilled in the art that the cross-sectional shape of the receiving post 18 can take may forms, with the arrowhead shape being one form thereof. Alternately, the post 18 may have a semicircular cross-sectional shape, or the like, which permits cam-like movement of the guide surfaces 50*a,b*. Such alternate post 18 shapes are within the scope of the present invention.

In a preferred form, the latch 10 is formed of a plastic or resin based material. Such a material provides the strength need to assure integrity of the latch 10 and to prevent inadvertent opening of the latch 10 and associated enclosure. Other materials may be used to form the present latch, including but not limited to, other polymeric-based materials. Such materials should be selected with consideration given to those properties which provide the necessary strength and flexibility characteristics.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A safety latch for latching a door of an enclosure to the enclosure, comprising:

a receiving member having a base portion for mounting to a fixed surface of the enclosure, and a receiving post extending from said base portion, said receiving post having first and second diverging surfaces;

a latching member engageable with said receiving post, said latching member having a base portion for mounting to the door, and having first and second generally symmetrical, spaced apart, biased latching elements, said latching elements extending from one end connected to said base portion to a second end and being biased toward one another, and configured for independent locking engagement with said receiving post when said receiving post is inserted into said latching member, each of said latching elements including a releasing member extending therefrom and operably connected thereto for releasing said latching element from locking engagement with said receiving post.

2. The safety latch of claim 1 wherein said latching elements are opposingly oriented.

3. The safety latch of claim 1 wherein each said latching element includes a hook-shaped portion extending toward the other said latching element, said hook-shaped portions defining a substantially enclosed latching region, wherein said hook-shaped potions are engageable with said receiving post when said post is disposed within said latching region.

4. The safety latch of claim 3 wherein said releasing members are connected to their respective latching elements by a lever portion, and wherein movement of said releasing members toward one another moves said hook shaped portions away from one another to thereby release said latching member from said receiving post.

5. The safety latch of claim 1 wherein said latching elements each include an inclined guide surface extending from an end thereof distally of said base portion, each said guide surface diverging from the other, said guide surfaces being adapted to engage and move along said receiving post in a camming manner when said latching member is engaged therewith, to facilitate insertion of said receiving post into said latching member.

6. The safety latch of claim 1 wherein said receiving post includes a pair of locking projections extending from said diverging surfaces, said locking projections enhancing engagement of said latching member to said receiving post.

7. The safety latch of claim 4 wherein said releasing members extend from each said latching element intermediate said base portion and said hook shaped portion, said releasing members extending generally toward said base portion, and being adapted to release said latching member from said receiving post when said releasing members are urged, toward one another, to separate said hook shaped portions, one from the other, to permit disengagement of said latch member from said post.

8. The safety latch of claim 1 wherein at least one of said receiving member base portion and said latching member base portion defines slotted openings therein for adjustable mounting of said at least one of said receiving member base portion and said latching member base portion relative to a respective other one of said receiving member base portion and said latching member base portion.

9. A safety latch for latching a door of an associated enclosure comprising:

a receiving member adapted to be mounted to the enclosure, said receiving member including a receiving post having at least one locking member thereon; and a latching member including a pair of spaced apart, opposingly oriented latching elements, said latching elements extending from a first end to a second end and being independently engageable with said receiving post, said latching elements including hook members which define a substantially enclosed latching region when said latching elements are in their biased state, said latching region enclosing said receiving post when the safety latch is in a latched condition, each said latching element further including a releasing portion thereon extending from intermediate said first and second ends and configured to move said latching elements from said biased state to a state wherein said latching elements permit release of said receiving post from said latching region to disengage said receiving post from said latching member.

10. The safety latch of claim 9 wherein said hook members each include a locking projection extending therefrom for engaging said receiving post to secure said post in said latching region when said post is disposed therein.

11. The safety latch of claim 9 wherein said receiving post includes a pair of diverging surfaces adapted to coact with said latching member in a camming manner to facilitate engagement of said latching member with said receiving post.

12. The safety latch of claim 9 wherein said latching member includes a pair of inclined guide surfaces adapted to coact with said receiving post in a camming manner to facilitate engagement of said latching member with said receiving post.

13. The safety latch of claim 10 wherein said receiving post includes a pair of locking lips extending therefrom configured to engage said locking projections to enhance engagement of said latching member with said receiving post.

* * * * *